US007503728B2

(12) United States Patent
Martin et al.

(10) Patent No.: US 7,503,728 B2
(45) Date of Patent: Mar. 17, 2009

(54) STABILIZED FLOATING SUPPORT

(75) Inventors: Yves Martin, La Seyne sur Mer (FR); Jean-François Desplat, Montesson (FR)

(73) Assignee: D2M Consultants, S.A., La-Seyne-sur-Mer (FR)

( * ) Notice: Subject to any disclaimer, the term of this patent is extended or adjusted under 35 U.S.C. 154(b) by 10 days.

(21) Appl. No.: 11/814,303

(22) PCT Filed: Jan. 17, 2006

(86) PCT No.: PCT/FR2006/000103

§ 371 (c)(1),
(2), (4) Date: Sep. 25, 2007

(87) PCT Pub. No.: WO2006/077311

PCT Pub. Date: Jul. 27, 2006

(65) Prior Publication Data

US 2008/0101870 A1 May 1, 2008

(30) Foreign Application Priority Data

Jan. 21, 2005 (FR) ..... 05 00676

(51) Int. Cl.
*E02B 17/00* (2006.01)

(52) U.S. Cl. ..... 405/195.1; 405/207; 405/224.2; 114/265

(58) Field of Classification Search ..... 405/195.1, 405/207, 224.4; 166/352; 114/265
See application file for complete search history.

(56) References Cited

U.S. PATENT DOCUMENTS 3,490,406 A * 1/1970 O'Reilly et al. ..... 114/265
4,015,552 A * 4/1977 Korkut ..... 114/265
2002/0166698 A1 11/2002 Beato et al.

FOREIGN PATENT DOCUMENTS

EP 0359702 A 3/1990
FR 2338183 A 8/1977

* cited by examiner

*Primary Examiner*—Tara L. Mayo
(74) *Attorney, Agent, or Firm*—Harness, Dickey & Pierce, PLC

(57) ABSTRACT

The support (1) includes a working deck (2) and floatation members (3) supporting this deck (2). According to the invention, the spacing between the vertical axes (Z) passing through the centre of the floatation members (3) is such that the sum of the moments, taken in relation to the horizontal axis passing through the centre of the support (1) is perpendicular to the swell direction, of the vertical excitation forces of the swell on the floatation members (3) situated on one side of the vertical plane (P) passing through this horizontal axis is equal to the corresponding sum associated with the floatation members (3) situated on the other side of this plane, when the swell period is equal to the period of a swell having this direction and of which the yearly probability of being encountered on the site or the support where it is installed is 1/100.

10 Claims, 2 Drawing Sheets

STABILIZED FLOATING SUPPORT

FIELD

Figure 1:
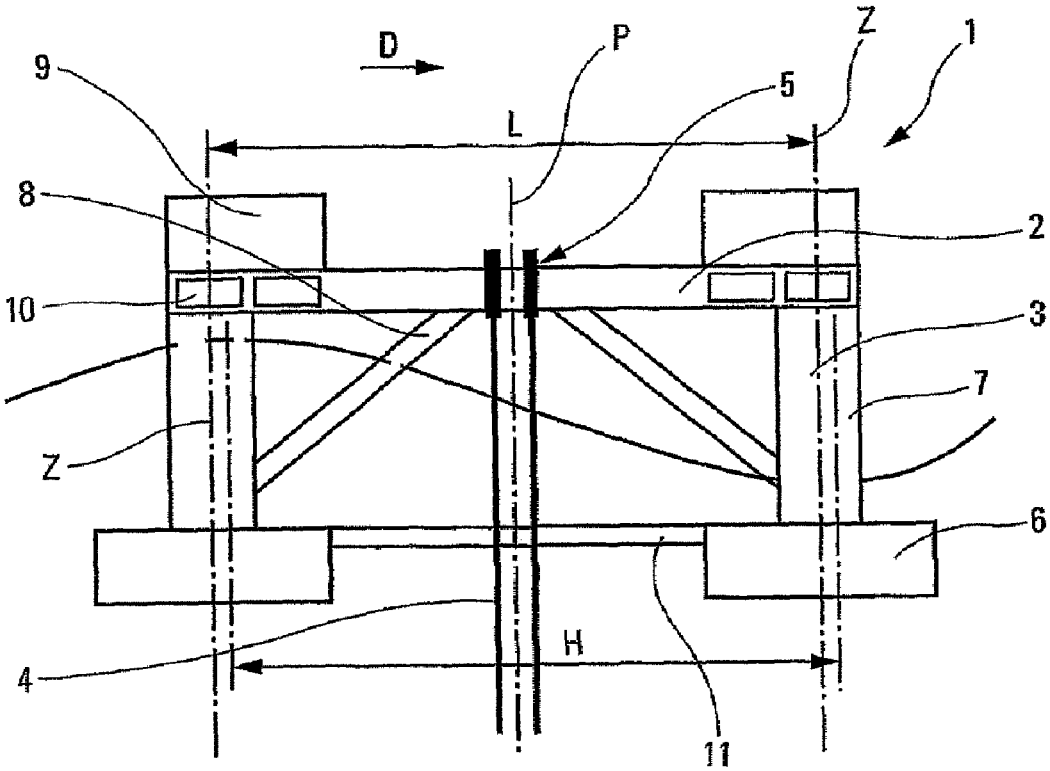

This invention relates to a floating support which includes a working deck supporting structures connected to the sea floor, and floatation members supporting the working deck. A platform such as this, for example, can be an oil or gas production platform.

BACKGROUND

An offshore floating support moves vertically with the swell. This vertical movement, commonly referred to as heaving, is swell-dependent and is particularly important because it affects the operation of the structures which are both supported by the floating support and connected to the sea floor. These structures, for example, can be drill pipes or pipelines enabling the transport of oil or natural gas. When the floating support heaves, these structures move vertically in relation to the support and, for this reason, it is necessary to equip these structures with telescopic compensation systems making it possible to always compensate for the heaving of the floating support, in order to enable operations at the upper portion of these structures. These compensation systems are very costly, all the more so if the movement compensation to be made is significant, and furthermore, they have technological compensation limits.

The heaving movement is approximately proportional to the swell height, and it is conventionally characterised by the ratio of the heave to the swell height, this ratio first being an approximation, an invariant with respect to the swell height. The heaving movement also depends on the shape of the floatation members, the effect of the swell generating pressure on the walls thereof, of which the cumulative effect on all of the walls always results in a vertical excitation force of the movement. The heaving movement also depends on the swell period, given that the distribution of pressure on a floatation member having a predetermined shape depends on the swell period and on the wavelength thereof (to this end, in deep water, the wavelength of the swell (in meters) corresponds approximately to the square of its period (in seconds) multiplied by 1.56). Finally, the heave also depends on the angle of attack of the swell, i.e., the orientation of the floating support in relation to the direction of swell propagation.

For this reason, the heaving movement of the support, at the geometric centre thereof, (generally the point of connection with the structures connected to the sea floor), is characterised by a heave transfer function, which is the representation of the evolution of the heave/swell height ratio in relation to the swell period.

In order to minimise the heaving movement, in current so-called semi-submersible platforms, each floatation member (typically consisting of a submerged float, the submerged portion of a column supported by the submerged float and supporting the working deck, and half of each of the adjacent submerged connection elements connecting the column-float assembly to the other column-float assemblies) is shaped in such a way that the cumulative effects of the pressures generated by the swell is cancelled out for a predetermined period, conventionally referred to as a balancing period. The heave transfer function for such a platform has a value close to 0 for small periods, increases steadily in order to reach a relative maximum, which is approximately equal to 0.5, drops to 0 again for the balancing period, and then rises again quickly and sharply.

Thus, in the prior art, limitation of the heaving movement is carried out by properly configuring each floatation member of the floating support so that the balancing period that is associated with them is greater than the swell periods ordinarily encountered on the platform operating site. For this reason, for ordinary swells at the site, the heave transfer function will be at most equal to 0.5.

However, this value of 0.5 is relatively significant and involves the use of relatively large compensation systems. Furthermore, the heave transfer function is greater that 0.25 for a significant range of swell periods.

In addition, it is known, e.g., according to U.S. Pat. No. 3,490,406, irrespective of the distance separating the vertical axes passing through the centre of buoyancy of the floatation members, that the heave is particularly abated when the floating support is subjected to a swell the propagation direction of which is that joining the two vertical axes and the period of which is equal to twice the distance separating these two axes.

SUMMARY

This invention aims to produce a floating support having a particularly small heave transfer function for ordinary swells.

According to the invention, the spacing between the vertical axes passing through the centre of buoyancy of the floatation members is such that, for each swell propagation direction, when the swell period is equal, within 20%, to the 100-year storm surge period associated with the propagation direction under consideration, the 100-year storm surge being the swell of which the yearly probability of being encountered at the site where the support is intended to be installed is 1/100, the sum of the moments, taken in relation to the horizontal axis perpendicular to the propagation direction under consideration and passing through the centre of gravity of the support, of the vertical excitation forces of the swell on the floatation members situated on one side of the vertical plane passing through this horizontal axis, is equal to the corresponding sum associated with the floatation members situated on the other side of this vertical plane.

Thus, according to this invention, the floating support is shaped such that, for each swell propagation direction, the sum of the moments taken in relation to the horizontal axis perpendicular to the propagation direction under consideration and passing through the centre of gravity of the platform, of the vertical excitation forces of the swell on the floatation members situated on one side of the vertical plane passing through this horizontal axis, is equal to the corresponding sum associated with the floatation members situated on the other side of this vertical plane, for a predetermined swell period, hereinafter referred to as the attenuation period. The heave transfer function of such a platform, for the swell propagation direction under consideration, thus has a value close to 0 for the attenuation period. Cancellation of the heaving movement at the centre of gravity for the attenuation period, according to the swell propagation direction, is a result of the fact that, with a predetermined spacing between the various vertical axes passing through the centre of buoyancy of the floatation members, the sum of the moments, taken in relation to the horizontal axis perpendicular to propagation direction under consideration and passing through the centre of gravity of the platform, of the vertical excitation forces of the swell on the floatation members situated on one side of the vertical plane passing through this horizontal axis, is equal to the corresponding sum associated with the floatation members situated on the other side of this vertical plane, although each of the forces on each floatation member taken separately is non-null.

The phenomenon can be easily understood by imagining a floating support including a working deck and two floatation members. When the half wavelength of the swell is the distance separating the two vertical axes passing through the centre of buoyancy of the floatation members, and its propagation direction is the direction of alignment of the two axes, these floatation members are subjected to out-of-phase vertical forces, because of the swell excitation (one being situated perpendicular to a crest when the other is perpendicular to a trough, for example) and, accordingly, the moment, taken in relation to the horizontal axis perpendicular to the propagation direction under consideration and passing through the centre point of the deck (situated half-way between the floatation members), of the vertical excitation forces of the swell on one of the two floatation members, is equal to the corresponding moment associated with the other floatation member. The swell period corresponding to this half wavelength is the support attenuation period. Furthermore, when the swell propagation direction is perpendicular to the direction of alignment of the two vertical axes, there is no attenuation period for this propagation direction.

According to one particularly advantageous embodiment, each floatation member is dimensioned (ordinarily) so that the sum of the vertical excitation forces that it withstands are cancelled out for a swell the period of which is equal to 1.5 times the period of the 100-year storm surge. Thus, according to this embodiment, the balancing period is equal to 1.5 times the attenuation period.

The heave transfer function at the centre of gravity of such a platform is then particularly remarkable: it has a value close to 0 for small periods, increases steadily in order to reach a first relative maximum, which is lower than 0.1 (approximately equal to 0.075), drops back down to 0 for the attenuation period, once again increases steadily in order to reach a second relative maximum, which is lower than 0.15 (approximately equal to 0.125), drops back down to 0 for the balancing period, and then rises again quickly and sharply. With a platform such as this, the compensation systems used can have a low compensation amplitude, the heave transfer function being at most equal to 0.15 for all of the swells encountered on the site.

DRAWINGS

Other characteristics will become more apparent in the description of the invention in conjunction with the drawings provided for non-limiting illustrative purposes.

Figure 2:
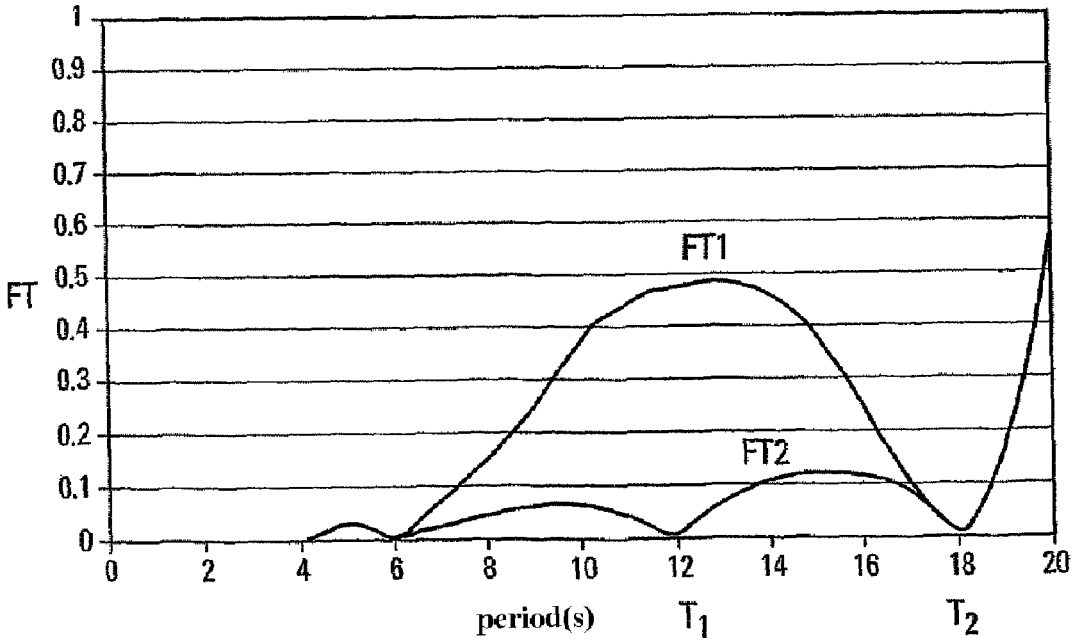
Figure 3:
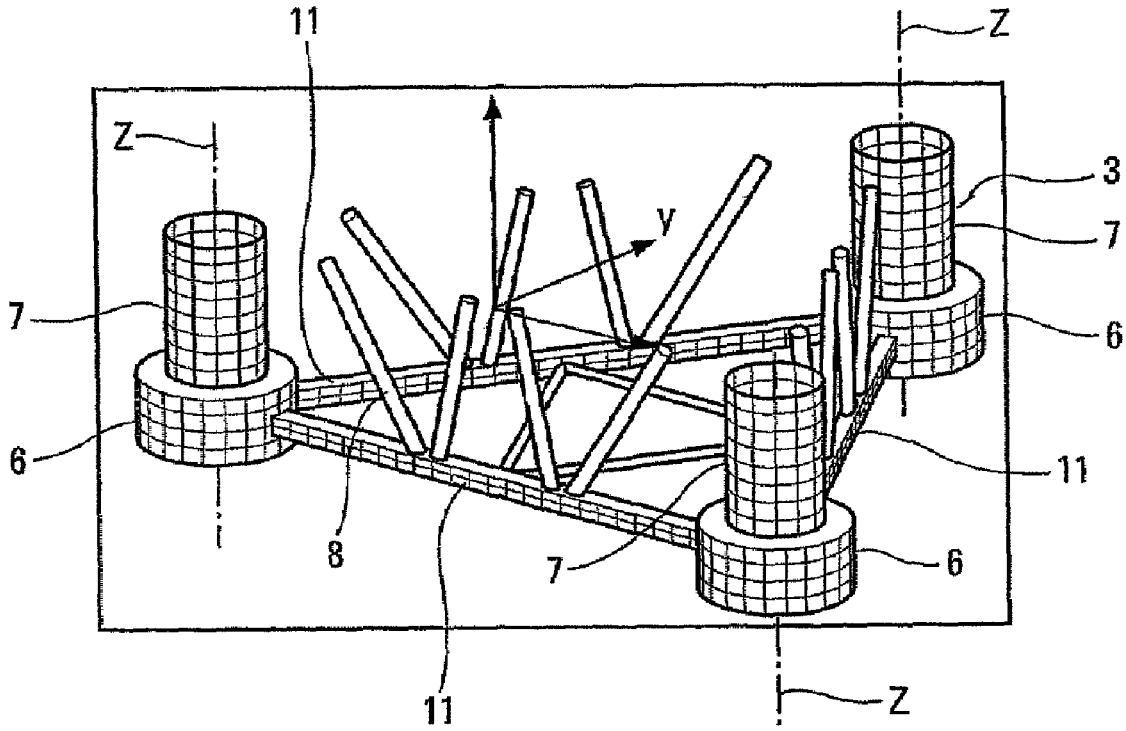

FIG. 1 is a sectional diagram showing the principle of this invention for a floating structure having four floatation members, the section being made along a vertical plane passing through the centre of the deck, FIG. 2 is a diagram showing the value of the heave transfer function at the centre of gravity for a platform designed in accordance with this invention, and that for a conventional semi-submersible platform, and FIG. 3 shows the submerged portion of a platform comprising three floatation members.

DETAILED DESCRIPTION

The floating support 1 (in this case, the semi-submersible platform 1) shown in FIG. 1 includes a working deck 2 and four floatation members 3 supporting the deck 2. Structures 4 (in this case, pipelines) which are connected to the sea floor, are supported by and connected to the deck 2, at the geometric centre 5 thereof. Each floatation member 3 consists of a submerged float 6, the submerged portion of a column 7 which is supported by the float 6 and which supports the working deck 2, and half of each submerged connection element 11 connecting this float-column assembly to the other float-column assemblies.

In the embodiment shown in FIG. 1, the four floatation members 3 are arranged so that the vertical axes Z passing through their respective centres of buoyancy form a square, and the distance L separating the two vertical axes Z delimiting the same side of the square is equal to the half wavelength H of a swell the direction of movement of which corresponds to the direction of alignment D of these two vertical axes Z. For this reason, and due to the swell, the four floatation members 3 are subjected in pairs to out-of-phase vertical excitation forces and, accordingly, the sum of the moments, taken in relation to the horizontal axis perpendicular to the propagation direction under consideration and passing through the centre of gravity of the support (generally close to the geometric centre 5 of the deck 2), of the vertical excitation forces of the swell on the floatation members 3 situated on one side of the vertical plane P passing through this horizontal axis is equal to the corresponding sum associated with the floatation members 3 situated on the other side of this vertical plane P. The swell period corresponding to this half wavelength is the support 1 attenuation period, when the propagation direction of the swell is the direction of alignment D of the two axes Z.

The dimensioning of the platforms 1 in accordance with this invention is carried out in the following way:

In a first phase, for the operation site for which the platform 1 is intended, it is necessary to identify, for each swell propagation direction, the 100-year storm surge period, which is the swell of which the yearly probability of being encountered on the site is 1/100, this swell period will be within 20% of the attenuation period chosen for the platform 1, in the propagation direction under consideration.

In a second phase, for a floating support 1 having a particular geometry (e.g., having three floatation members 3 arranged so that their vertical axes Z passing through their respective centres of buoyancy form an equilateral triangle, as shown in FIG. 3, or having four floatation members 3 arranged so that their vertical axes Z passing through their respective centres of buoyancy form a square like the one shown in FIG. 1), the theoretical spacing between the vertical axes Z is determined so that the sum of the moments, taken in relation to the horizontal axis perpendicular to the swell propagation direction and passing through the geometric centre 5 of the deck 2 (generally close to the centre of gravity of the platform 1), of the vertical excitation forces of the swell on the floatation members 3 situated on one side of the vertical plane P passing through this horizontal axis is equal to the corresponding sum associated with the floatation members 3 situated on the other side of this vertical plane P, for the swell the period of which corresponds to the attenuation period.

Determination of this theoretical spacing is carried out for an entire range of swell propagation directions. In view of conceivable symmetries, for a platform 1 having three floatation members 3 arranged in the shape of an equilateral triangle, the swell propagation direction can vary by 60°, and for a platform 1 having four floatation members 3 arranged in the shape of a square, it can vary by 45°. This determination for various propagation directions makes it possible to choose an optimum spacing with respect to the heaving behaviour of the platform 1, for 100-year storm surges, which defines the attenuation period of the platform 1 for the propagation direction under consideration. A tolerance of 20% with regard to the attenuation period makes it possible to adapt the geometry of the platform without excessively impairing its heave behaviour.

In the case of a platform 1 having four floatation members 3 arranged so that the vertical axes Z passing through their respective centres of buoyancy form a square, the attenuation period, for the swell propagation direction parallel to one side of the square, is obtained when the length of one side of the square corresponds to the half wavelength of the 100-year storm surge. In the case of a platform 1 having three floatation members 3 arranged so that the vertical axes Z passing through their respective centres of buoyancy form an equilateral triangle, the attenuation period is obtained when the height of the triangle corresponds to the half wavelength of the 100-year storm surge. Thus, for an attenuation period of 12 s, the wavelength of the corresponding swell is 224 m, the height of the equilateral triangle formed by the three vertical axes Z is 112 m, and the spacing between each vertical axis Z is 130 m.

According to one particular embodiment, each floatation member 3 is dimensioned (ordinarily) so that the sum of the vertical excitation forces to which it is subjected is cancelled out for a swell the period of which is greater than the attenuation period, i.e., each floatation member is dimensioned so that the balancing period associated with it is greater than the attenuation period.

It is particularly advantageous for the period of each floatation member 3 to be equal to approximately 1.5 times the attenuation period. Thus, for a platform 1 having an attenuation period of 12 s, it is particularly advantageous for each floatation member 3 to be dimensioned to have a balancing period of 18 s.

FIG. 3 shows a platform with three floatation members 3 arranged so that the vertical axes Z passing through their respective centres of buoyancy form an equilateral triangle, and having an attenuation period of 12 s (the distance between the vertical axes Z is thus 130 m). Each floatation member 3 is configured so as to have a balancing period of 18 s, the submerged float 6 being in the form of a cylinder of 30 meters in diameter, and the column 7 being in the form of a cylinder of 18 meters in diameter, the draught at the operation site being 44 meters. The weight of the platform, including that of the oil processing equipment that it supports, is 65,000 tons.

FIG. 2 is the representation of the heave transfer function for two platforms both having the same balancing period of 18 s and comprising three floatation members 3 arranged so that the vertical axes Z passing through their respective centres of buoyancy form an equilateral triangle.

The first curve FT1 corresponds to an ordinary platform which is conventionally dimensioned and suitable for heavy swells of 12 s, the vertical axes Z being spaced apart from one another by approximately 70 meters: the heave transfer function has a value close to 0 for small periods (less than 6 s), increases steadily in order to reach a relative maximum which is approximately equal to 0.5 (for a period of approximately 13 s), drops back down to 0 for the balancing period (18 s), and then rises again quickly and sharply.

The second curve FT2 corresponds to a platform dimensioned in accordance with this invention, the spacing between the vertical axes Z being 130 m so as to have an attenuation period of 12 s: the heave transfer function has a value close to 0 for small periods (less than 6 s), increases steadily in order to reach a relative maximum which is approximately equal to 0.075 (for a period of approximately 10 s), drops back down to 0 for the attenuation period (12 s), steadily increases again in order to reach a second relative maximum which is approximately equal to 0.125 (for a period of approximately 15 s), drops back down again to 0 for the balancing period (18 s), and then rises again quickly and sharply.

The offshore behaviour of a platform 1 in accordance with this invention is particularly improved.

The ranges of variation for the value of the attenuation and balancing periods makes it possible to obtain this good behaviour, while at the same time allowing flexibility in constructing the platform using other dimensioning parameters.

Given the dimensions of such platforms 1, as can be seen in FIG. 1, it is advantageous for the deck 2 and the floatation members 3 to be rigidly joined together via attached structures 8. Furthermore, it is preferable for only the structures connected to the sea floor (the pipelines 4 or the drill pipes, as well as the structures which enable them to be guided near sea level) to be situated at the geometric centre 5 of the deck 2, the associated structures 9 being capable of being brought together above the columns 7 in order to limit stress in the structures of the working deck 2.

Furthermore, the working deck 2 can comprise volumes 10 capable of being made watertight, so as to ensure the safety of the floating support 1, in the event of damage to a floatation member 3 resulting in it being flooded with sea water.

With regard to this invention, which makes it possible to limit the vertical movement of the working deck 2 with respect to its interconnection with the structures 4 connected to the sea floor, it is also possible to limit the mechanical stresses experienced by these structures with respect to this interconnection, which are due to the pitching, rolling, lurching and surge movements of the platform 1.

To that end, the platform 1 is associated with a guide structure which is designed to be supported by the platform and to guide, near sea level, the structures 4 (e.g., the pipelines 4) connected to the sea floor. The guide structure includes a cage which runs in a longitudinal direction (which corresponds substantially to vertical when the structure is connected to the platform) and a connecting member that is designed to cooperate with a complementary connecting member held by the platform, so as to form a swivel connection between said platform and the cage. In this way, when the platform is subjected to the effects of the swell, the swivel connection makes the guide structure less sensitive to the overall movement of the platform, which sharply reduces the contact forces between the pipelines and the guide structures. The guide structure can advantageously support vertical tensioning systems for the pipelines, wellheads, a derrick, etc. The connecting member can be arranged longitudinally at the end of the cage and, transversely, either at the centre of the cage (the member is then a spherical spindle) or at the periphery of the cage (the member is then a spherical ring).

According one particular embodiment, the guide structure also includes a ballast-forming element, which is arranged at a portion of the cage longitudinally distant from the connecting member (the ballast-forming element is fastened to the longitudinal end of the cage opposite that where the connecting member is arranged). While the sea currents have a tendency to deflect the cage and the pipelines from vertical because of the swivel connection between the cage and the floating support, the ballast-forming element tends to reduce this deviation and therefore protects the pipelines from mechanical stresses resulting from this deviation. A ballast-forming element such as this has a weight to submerged volume ratio at least equal to twice (or even three times) that of the cage.

According to another particular embodiment, in order to reduce the vertical forces between the cage and the platform at the swivel connection, floats are attached to the upper portion of the cage, and more precisely at the level of the cage that is designed to be near sea level.

What is claimed is:

1. A floating support designed to support structures designed to be connected to the sea floor of a given site, the floating support including a working deck and floatation members which support the working deck, wherein the spacing between the vertical axes passing through the centre of buoyancy of the floatation members is such that, for each swell propagation direction, when the swell period is equal, within 20%, to the 100-year storm surge period associated with the propagation direction under consideration, the 100-year storm surge being the swell of which the yearly probability of being encountered at the site where the support is intended to be installed is 1/100, the sum of the moments, taken in relation to the horizontal axis perpendicular to the propagation direction under consideration and passing through the centre of gravity of the support, of the vertical excitation forces of the swell on the floatation members situated on one side of the vertical plane passing through this horizontal axis, is equal to the corresponding sum associated with the floatation members situated on the other side of this vertical plane, this period being referred to as the attenuation period according to the swell propagation direction.

2. The floating support of claim 1, wherein the floating support includes three floatation members arranged in relation to one another so that the vertical axes passing through their respective centres of buoyancy form an equilateral triangle the height of which corresponds, within 20%, to the half wavelength of the 100-year storm surge.

3. The floating support of claim 1, wherein the floating support includes four floatation members arranged in relation to one another so that the vertical axes passing through their respective centres of buoyancy form a square of which the length of the sides of which corresponds, within 20%, to the half wavelength of the 100-year storm surge.

4. The floating support of claim 1, wherein each floatation member is dimensioned so that the sum of the vertical excitation forces that it undergoes is cancelled out for a swell the period of which is greater than the attenuation period, this period being referred to as the balancing period.

5. The floating support of claim 4, wherein the balancing period is equal to 1.5 times the attenuation period.

6. The floating support of claim 1, wherein the connecting point of the structures intended to be connected to the sea floor is the centre of gravity of the support.

7. The floating support of claim 6, wherein the structures intended to be connected to the sea floor are associated with attached structures arranged above the floatation members.

8. The floating support of claim 1, wherein each floating member consists of a submerged float, the submerged portion of a column supported by the submerged float and supporting the working deck, and half of each of the adjacent submerged connection elements connecting this column-float assembly to the other submerged column-float assemblies.

9. A method for dimensioning a floating support which is suitable for supporting structures designed to be connected to the sea floor of a given site, and which includes a working deck and floatation members supporting the working deck, wherein it includes a step during which identification is made, for the site to which the support is intended, for each swell propagation direction, of the 100-year storm surge period, which is the swell of which the yearly probability of being encountered on the site is 1/100, a step during which determination is made, for an entire range of swell propagation directions, of the theoretical spacing between the vertical axes passing through the centres of buoyancy of the floatation members, so that the sum of the moments, taken in relation to the horizontal axis perpendicular to the swell propagation direction and passing through the geometric centre of the deck, of the vertical excitation forces of the swell on the floatation members situated on one side of the vertical plane passing through this horizontal axis is equal to the corresponding sum associated with the floatation members situated on the other side of this vertical plane, a step during which determination is made of an optimum spacing with regard to the heave behaviour of the support for 100-year storm surges, which defines the attenuation period of the support for the propagation direction under consideration, and a possible step during which the geometry of the support is adapted within the limits of a tolerance of 20% with respect to the attenuation period.

10. The method for dimensioning a floating support of claim 9, wherein each floating member is dimensioned so that the sum of the vertical excitation forces that it undergoes is cancelled out for a swell of which the period is equal to 1.5 times the attenuation period.

* * * * *